US005697880A

United States Patent [19]

Auerbach

[11] Patent Number: 5,697,880

[45] Date of Patent: *Dec. 16, 1997

[54] INSERTER INCLUDING A PIVOTING CONVEYOR MODULE WITH STAGING CAPABILITY

[75] Inventor: David R. Auerbach, Redding, Conn.

[73] Assignee: Pitney Bowes Inc., Stamford, Conn

[ * ] Notice: The term of this patent shall not extend beyond the expiration date of Pat. No. 5,649,892.

[21] Appl. No.: 406,288

[22] Filed: Mar. 17, 1995

[51] Int. Cl.[6] ..... B31F 1/00

[52] U.S. Cl. ..... 493/420; 493/217; 493/29; 198/369.2

[58] Field of Search ..... 271/9, 13, 273, 271/198, 199, 258.03, 265.01; 270/45, 51; 198/369.2, 592, 801.5; 493/8, 9, 10, 12, 21, 22, 23, 25, 27, 28, 29, 416, 419, 420, 421, 436

[56] References Cited

U.S. PATENT DOCUMENTS

| | | | |
|---|---|---|---|
| 2,190,414 | 2/1940 | Davidson et al. | 270/62 |
| 2,230,168 | 1/1941 | Spiess | 270/68 |
| 2,253,446 | 8/1941 | Spiess | 493/420 |
| 3,580,141 | 5/1971 | Richter | 493/27 |
| 3,961,781 | 6/1976 | Funk | 270/20 |
| 4,570,923 | 2/1986 | Hooper et al. | 271/275 |
| 4,616,815 | 10/1986 | Vijuk | 270/45 |
| 4,618,302 | 10/1986 | Kokubo | 271/273 |
| 5,121,916 | 6/1992 | Sanchez | 271/198 |
| 5,137,506 | 8/1992 | Haenel | 493/417 |
| 5,180,157 | 1/1993 | Helit et al. | 271/256 |
| 5,183,246 | 2/1993 | Edwards | 270/45 |
| 5,275,395 | 1/1994 | Boggiano | 271/259 |
| 5,374,233 | 12/1994 | Lehmann | 493/421 |
| 5,433,431 | 7/1995 | Lowell | 271/273 |

FOREIGN PATENT DOCUMENTS

| | | | |
|---|---|---|---|
| 236716 | 6/1986 | German Dem. Rep. | 271/258.03 |
| 2262583 | 7/1973 | Germany | 271/258.03 |

*Primary Examiner*—Joseph J. Hail, III
*Assistant Examiner*—Christopher W. Day
*Attorney, Agent, or Firm*—Angelo N. Chaclas; Charles R. Malandra, Jr.; Melvin J. Scolnick

[57] ABSTRACT

An inserter comprising feeding a sheet in a path of travel, a first module for suspending feeding of the sheet, a folder module located downstream from the first module, a second module located downstream from the folder module, a conveyor module located downstream from the folder module and upstream from the second module and a microcontroller. The second module for detecting a jam. The conveyor module for conveying the sheet and for sensing the presence of the sheet. The microcontroller in operative communication with the first module, the folder module, the conveyor module and the second module. The microcontroller for: (a) signaling the conveyor module to stop conveying the sheet when the second module detects the jam; (b) signaling the first module to continue feeding the sheet in the path of travel when the conveyor module senses the trailing edge of the sheet; (c) commencing a count of a fold time interval when the first module continues to feed the sheet in the path of travel; (d) determining if the fold time interval count is less than a threshold time interval; and (e) signaling the conveyor module to terminate operation if the fold time interval count is not less than the threshold time interval.

7 Claims, 9 Drawing Sheets

INSERTER INCLUDING A PIVOTING CONVEYOR MODULE WITH STAGING CAPABILITY

RELATED APPLICATIONS

This application is related to copending U.S. patent application Ser. No. 08/406,286 entitled APPARATUS AND METHOD FOR CONVEYING A SHEET, filed concurrently herewith and assigned to the assignee of this application.

FIELD OF THE INVENTION

This invention relates to sheet processing machines having a sheet folder module. More particularly, this invention is directed to a pivoting conveyor module with staging capability for conveying a sheet away from the folder module.

BACKGROUND OF THE INVENTION

Machines for processing sheets of paper, such as inserters, are well known in the art. A typical inserter may include: a cut sheet feeder module, a web sheet burster module, an accumulator module, a right angle transport module, a folder module, an insert module and a moistener/sealer module. This list is not intended to be exhaustive, but merely illustrative, of the wide range of functionality that is often incorporated into an inserter. Generally, inserter manufacturers custom build each machine to meet the needs of a particular user or customer. As a result, an inserter may be comprised of different arrangements and combinations of modules according to the customer's needs.

Typically, inserters of the kind described above are used in printing, book binding and direct mailing operations. An example of such an inserter is Model 8300 available from Pitney Bowes Inc., Stamford, Conn.

Users of such inserters are not only interested in the particular operations performed by each module and their arrangement, but are also concerned with overall inserter system performance. Two important criteria used to evaluate inserters are: system throughput and system reliability. To assist in keeping their operating costs at a minimum, users want to process sheets through the inserter at the fastest rate possible and to operate the inserter without undesired interruptions caused by jams that necessitate operator intervention. Thus, speed and reliability are significant benchmarks which users utilize to compare and evaluate inserters.

So that the inserter can process sheets at the fastest rate possible, the spacing or distance between the trailing edge of one sheet and the leading edge of a subsequent sheet must be accurately controlled. If the spacing is too great, then system throughput will be compromised. On the other hand, if the spacing is too small, then the likelihood of a jam or a double mis-feed is increased. Therefore, the spacing must not be too great or too small but at some predetermined optimal distance. Upstream from the folder module the spacing is easy to control because the length of the sheet is known and constant. In operation, both the cut sheet feeder module and web burster module set the spacing between sheets by releasing sheets into the path of travel at a predetermined rate. Other modules upstream from the folder module, such as the right angle turn module and accumulator module, maintain this spacing.

So that the inserter can operate reliably, it is important to prevent jams from occurring. Despite intense efforts directed at this problem, jams still occur. In these situations, it is important to minimize the negative impact of the jam so that operator intervention to correct the jam is quick and simple. Thus, the inserter comes back "on-line" as soon as possible without a lot of "down time" which hurts productivity.

However, the folder module upsets the spacing because the sheets exit the folder module at a different length from which they enter the folder module. The folder module contains a series of pairs of folding rollers, buckle chutes, and end stops for folding a single sheet or a collection of sheets. Typically, each pair of folding rollers is offset both horizontally and vertically from the previous pair of folding rollers. Each buckle chute and corresponding pair of feed rollers is responsible for making a single fold in the sheet. The location of the fold along the sheet depends on how far the sheet is feed into the buckle chute and is thus controlled by the position of an adjustable end stop within the buckle chute. Accordingly, the buckle chutes can be arranged to create more than one fold in a sheet.

At each installation different final configurations for the sheet are required. These configurations vary depending on the needs of the user at the time. Examples of a few configurations that users desire to make are: half fold—a single fold that divides the sheet into two equal portions, C fold—a combination of two folds that divide the sheet into three substantially equal portions with the folded ends angled inward toward each other and Z fold—a combination of two folds that divide the sheet into three substantially equal portions with the folded ends angled away from each other. Additionally, other configurations may be desired which require three or four folds. Thus, the folder module must be capable of producing a wide variety of folds and also be flexible so as to adapt to new folding requirements. To accomplish this, the folder module includes adjustments which control the number of buckle chutes that the sheet encounters and also the distance that the sheet travels into each buckle chute. As a result, any desired configuration may be obtained. Accordingly, the sheet entering the folder module with a known length necessarily exits the folder module having a different length depending on the resulting fold configuration. Therefore, the optimal spacing between successive sheets that was established upstream from the folder module has been destroyed by the folder module.

After the sheet or sheets have been folded into the desired configuration, it is desirable to then feed them downstream to another module in the inserter for further processing and reestablish optimal spacing. Therefore, the need exists to operatively connect the output end of the folder module with the input end of the downstream module so that the sheet is automatically fed downstream. Additionally, the need exists to control the spacing between successive sheets so that overall inserter system throughput is not adversely affected. Furthermore, the need exists to minimize the negative impact of jams occurring in the inserter.

The capability to regulate the spacing between sheets is commonly referred to as staging. Generally, the input end of the downstream module is located at only one fixed horizontal elevation. In contrast, the output end of the folder module will be at one of several different horizontal elevations depending upon the desired fold configuration. Thus, the sheet will necessarily be output by different pairs of folding rollers. This fact greatly complicates operatively connecting the output end of the folder module to the downstream module input end because their respective horizontal elevations are different.

Accordingly, there is a need for an adaptable and flexible system that allows the output end of a folder module to be connected to the input end of the downstream module easily, quickly and cost effectively with the capability to control the spacing between the folded sheets as well as detect and prevent jams.

SUMMARY OF THE INVENTION

Accordingly, it is an object of the present invention to provide an apparatus and method which provides a practical solution to the problems discussed above.

It is another object of the present invention to provide an apparatus and method which reduces set-up time.

In accomplishing these and other objects there is provided an inserter comprising means for feeding a sheet in a path of travel, a first module including means for suspending feeding of the sheet, a folder module located downstream from the first module, a second module located downstream from the folder module, a conveyor module located downstream from the folder module and upstream from the second module and a microcontroller. The second module including means for detecting a jam. The conveyor module including means for conveying the sheet and means for sensing the presence of the sheet. The microcontroller in operative communication with the first module, the folder module, the conveyor module sensing means, the conveyor module conveying means and the second module detecting means. The microcontroller for: (a) signaling the conveyor module conveying means to stop conveying the sheet when the second module detecting means detects the jam; (b) signaling the first module suspending means to continue feeding the sheet in the path of travel when the conveyor module sensing means senses the trailing edge of the sheet; (c) commencing a count of a fold time interval when the first module suspending means continues to feed the sheet in the path of travel; (d) determining if the fold time interval count is less than a threshold time interval; and (e) signaling the conveyor module to terminate operation if the fold time interval count is not less than the threshold time interval.

Therefore, it is now apparent that the invention achieves all the above objects and advantages. Additional objects and advantages of the invention will be set forth in the description which follows, and in part will be obvious from the description and/or drawings, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

DETAILED DESCRIPTION OF THE PREFERRED EMBODIMENTS

Figure 1:
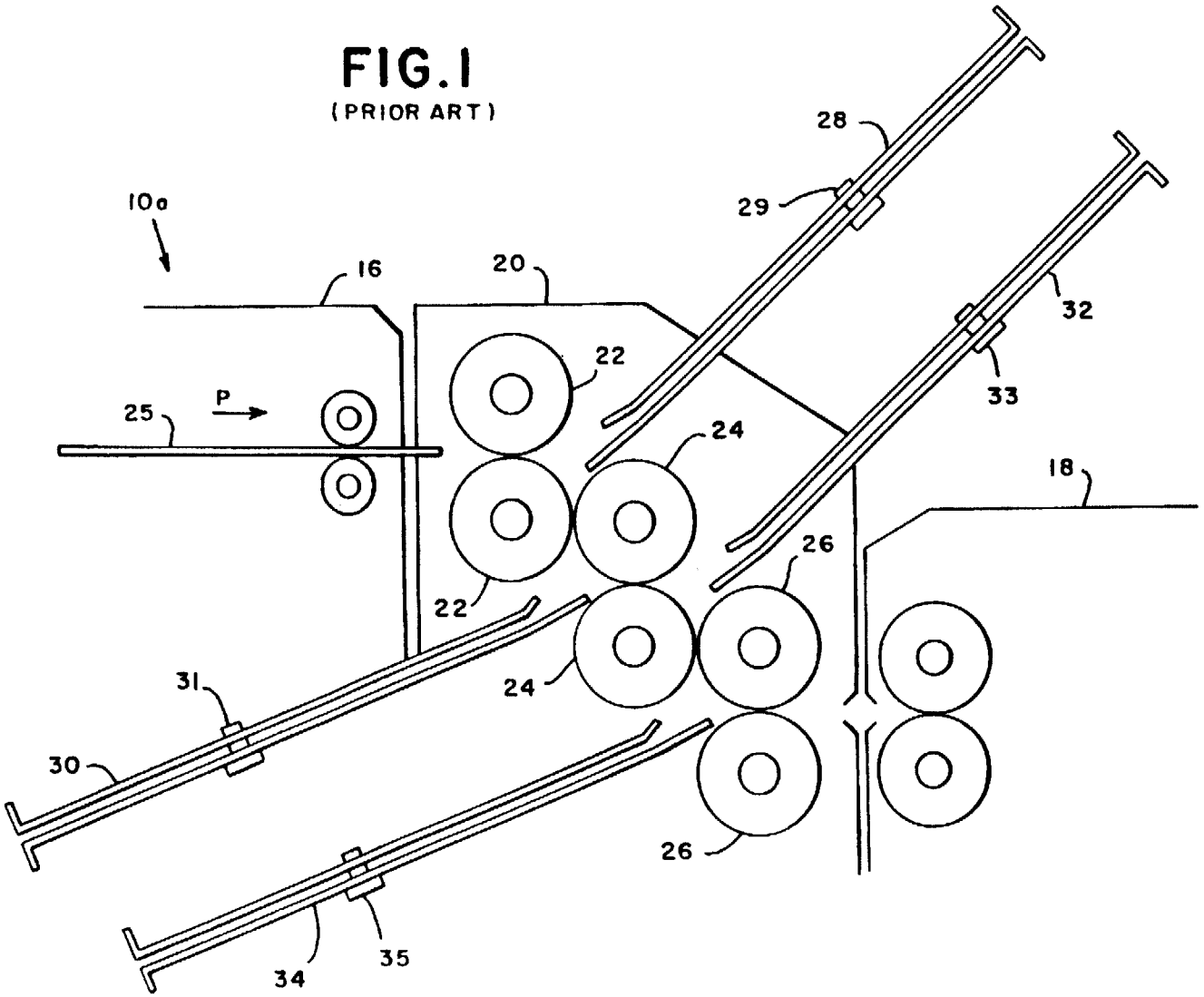
FIG. 1 (PRIOR ART)
FIG. 1 is a front view of a prior art folder module.

Referring to FIG. 1, a general purpose prior art inserter 10*a* is shown which includes a folder module 20, modules 16 and modules 18. A sheet 25 is feed through the inserter 10*a* in a downstream path of travel as indicated by arrows "P". As used herein, the term sheet refers generically to: cut paper sheets, tapes, checks, money, inserts and any other such suitable articles. Additionally, the term sheet 25 is meant to include both a single sheet 25 and an accumulation of more than one sheet 25. The modules 16 and 18 are represented as generic workstations each for performing a selected operation on the sheet 25, such as: web bursting, cut sheet feeding, accumulating, turning, inserting, etc. Those skilled in the art will appreciate that the individual operations performed by modules 16 and 18 are selected and arranged in a particular sequence according to the needs of the user or customer. Modules 16 are located upstream from the folder module 20 while modules 18 are located downstream. In order to understand and practice the present invention it is unnecessary to assign specific functions to the modules 16 and 18.

The folder module 20 accepts the incoming sheet 25 and folds it into a desired configuration according to the user's requirements. The folder module 20 includes: a first pair of folding rollers 22, a second pair of folding rollers 24, a third pair of folding rollers 26, a first buckle chute 28, a second buckle chute 30, a third buckle chute 32 and a fourth buckle chute 34. Each buckle chute 28, 30, 32 and 34 contains a corresponding end stop 29, 31, 33 and 35, respectively. Alternatively, any one or several of the buckle chutes 28, 30, 32 and 34 may be replaced or bypassed by a diverter (not shown). The diverter serves to direct the incoming sheet away from the buckle chute so that it does not enter the buckle chute. Thus, the number and sequencing of the buckle chutes 28, 30, 32 and 34 that are actually used can be controlled. The position of the end stops 29, 31, 33 and 35 along the buckle chutes 28, 30, 32 and 34, respectively, also determines the type of fold that is achieved. Therefore, by controlling the number and sequencing of the buckle chutes 28, 30, 32 and 34 that the sheet 25 encounters and by adjusting the position of the end stops 29, 31, 33 and 35, a desired fold configuration can be achieved. A more detailed description of a folder module is available in U.S. Pat. No. 5,183,246 issued on Feb. 2, 1993 entitled DIVERTING APPARATUS AND METHOD FOR IN-LINE INSERTING EQUIPMENT and in U.S. patent application Ser. No. 08,299,396, filed on Sep. 1, 1994 entitled BUCKLE CHUTE FOLDING MACHINE FOR DIFFERENT LENGTH SHEETS, both of which are assigned to the assignee of the present invention.

Figure 2:
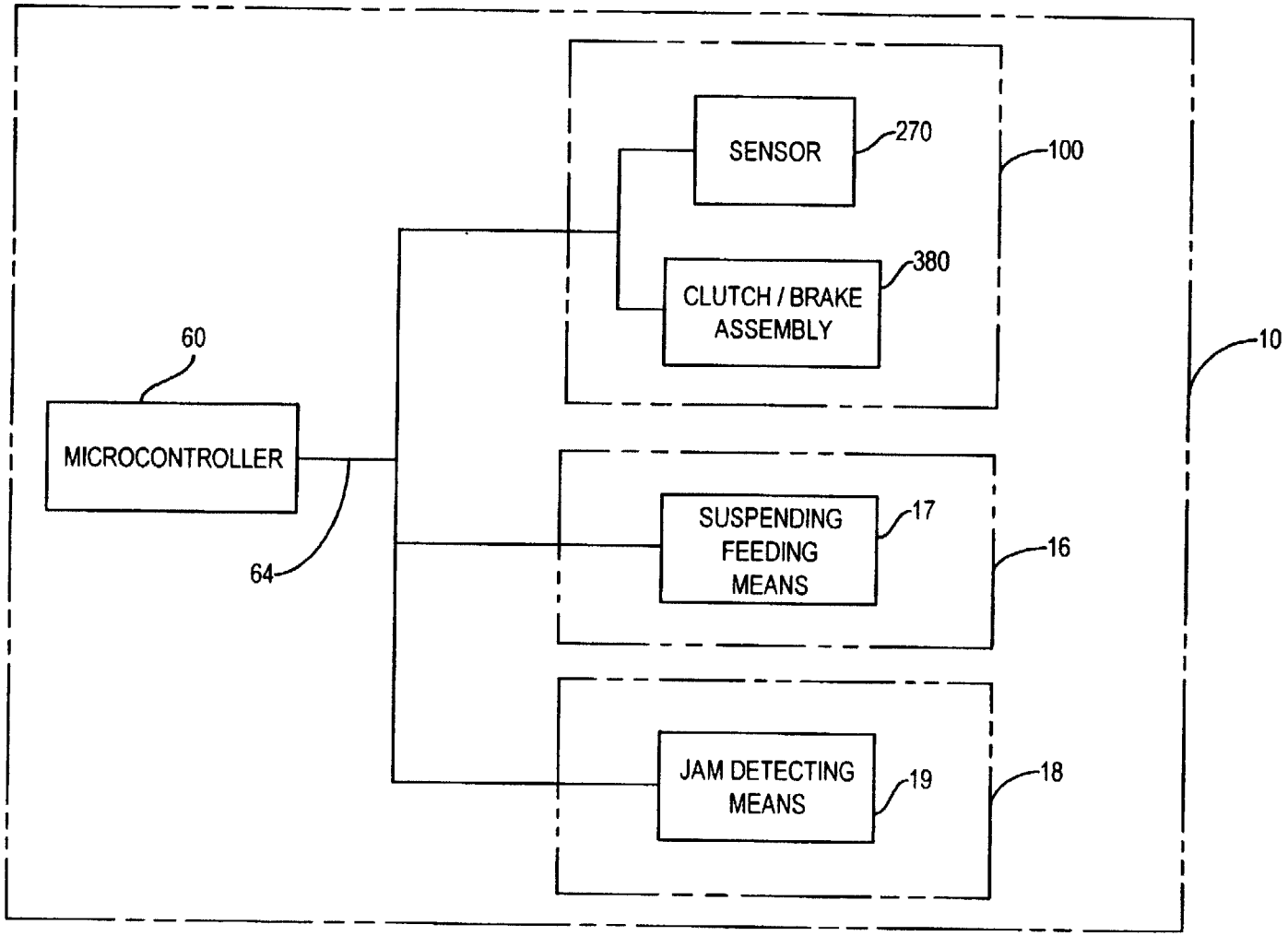
FIG. 2 is a block diagram of an inserter in accordance with the present invention.
Figure 3:
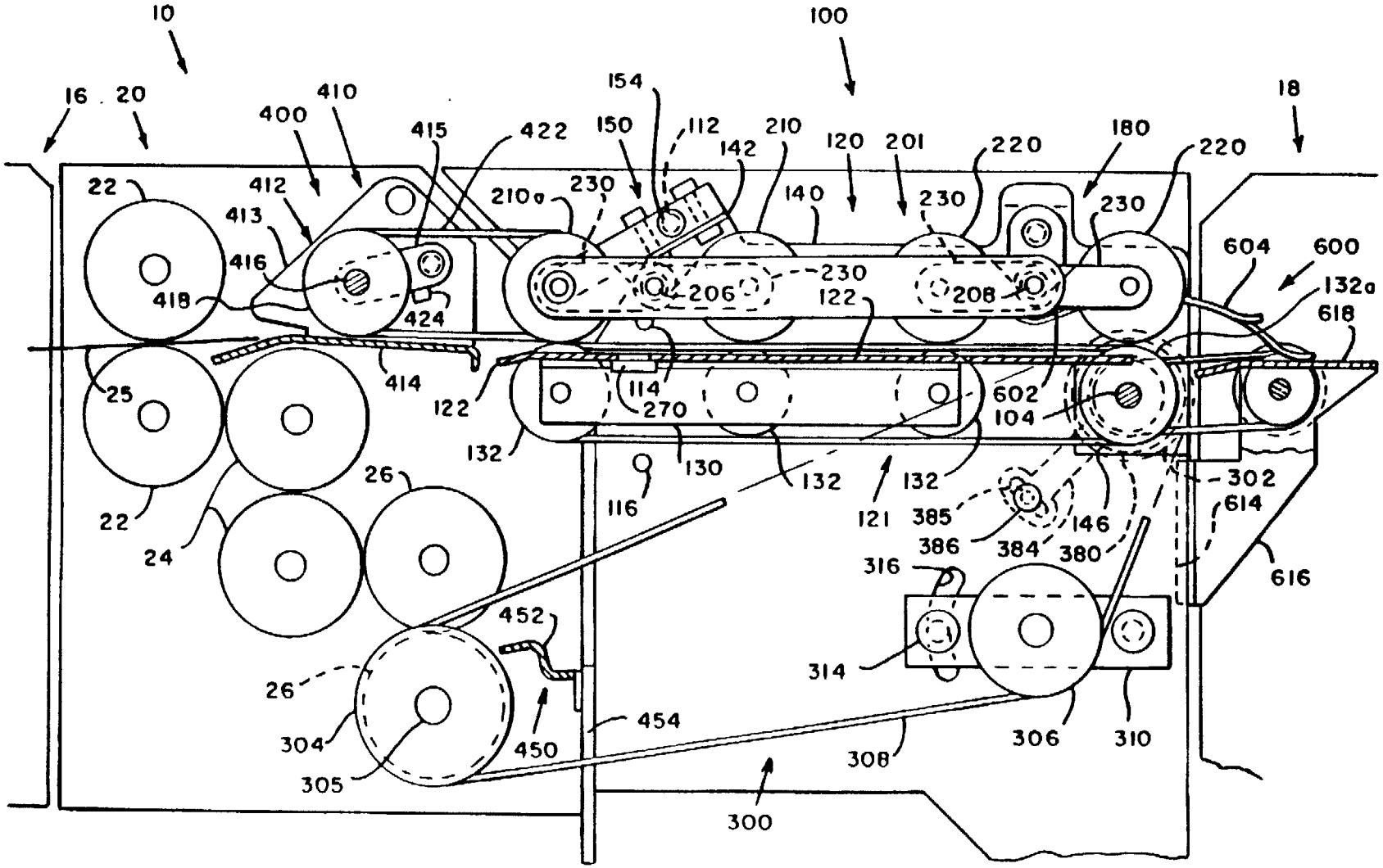
FIG. 3 is a front view of the folder module and a conveyor module in position A having an upper portion of a carriage assembly in a closed position in accordance with the present invention.
Figure 4:
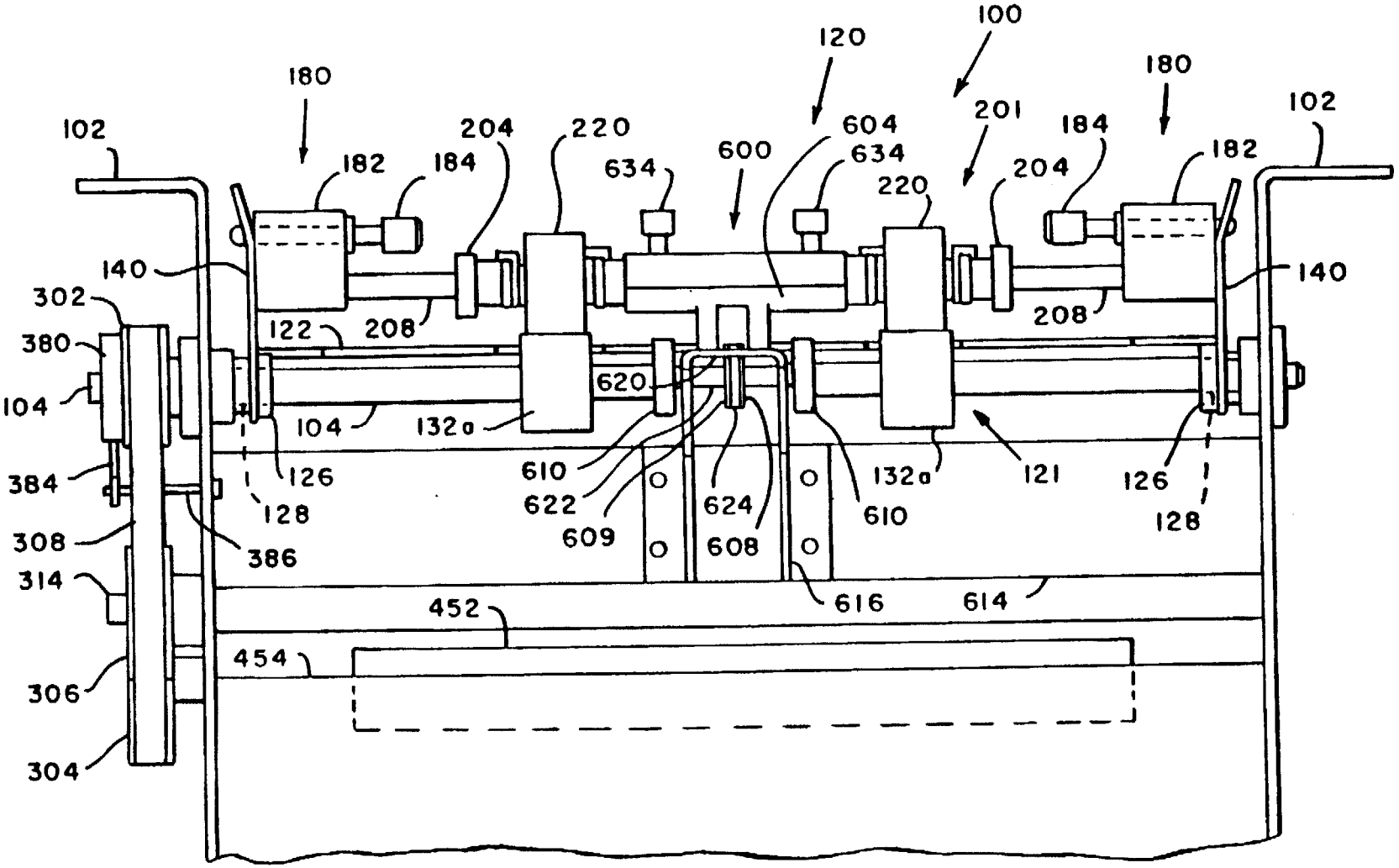
FIG. 4 is a right side view of the conveyor module in accordance with the present invention.
Figure 5:
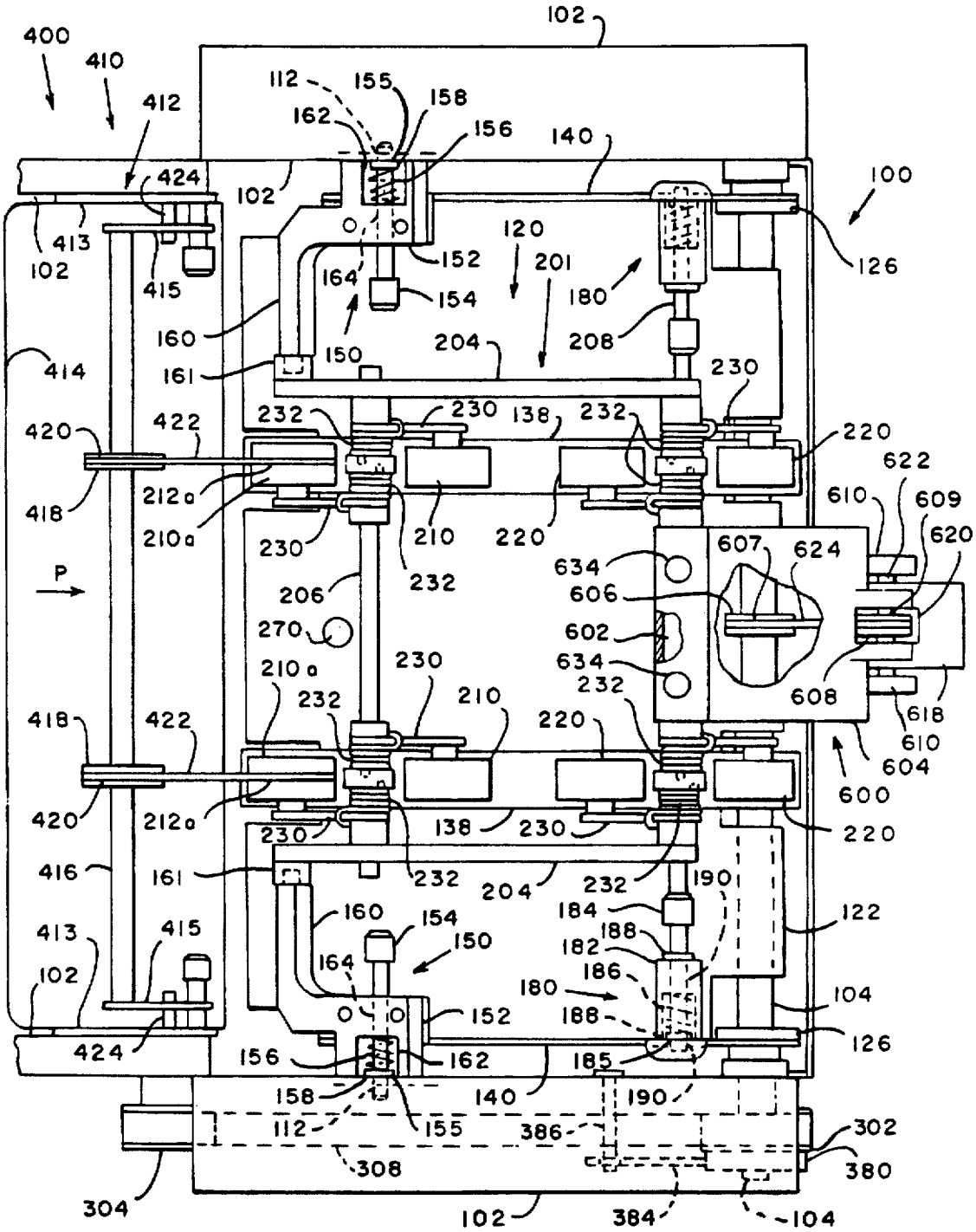
FIG. 5 is a plan view of the conveyor module in accordance with the present invention.
Figure 6:
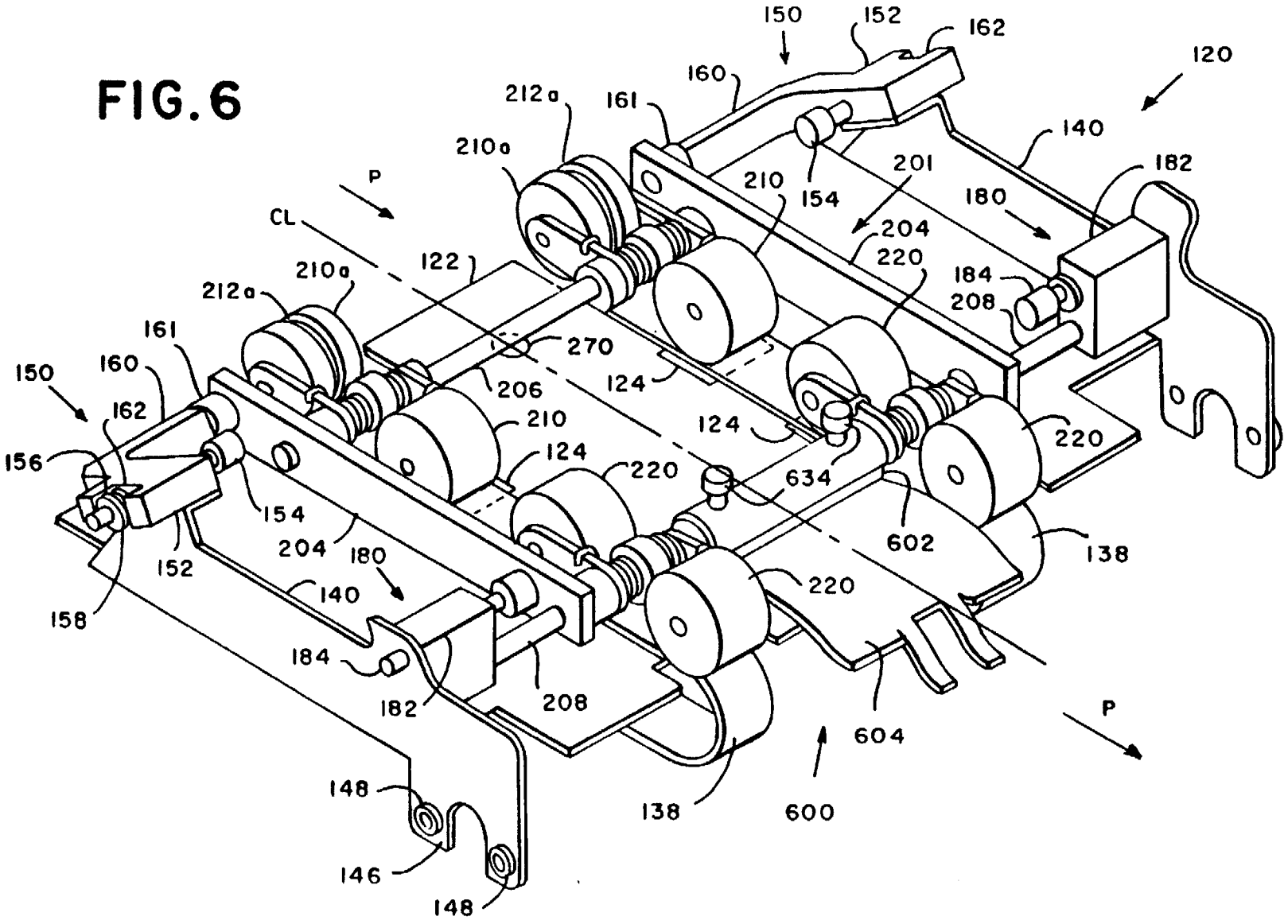
FIG. 6 is a front-right-plan perspective view of the conveyor module in accordance with the present invention.

Referring to FIGS. 2 and 3 an inserter 10 in accordance with the present invention is shown. The inserter 10 includes a microcontroller 60 communicating via a bus 64 with upstream modules 16, a conveyor module 100 and downstream modules 18. The conveyor module 100 is located downstream from and adjacent to folder module 20. The microcontroller 60 monitors and manages the flow of the sheet 25 as it progresses along the path of travel from upstream modules 16 to the folder module 20 and through the conveyor module 100 and downstream modules 18.

Referring to FIGS. 2, 3, 4, 5 and 6, the conveyor module 100 is shown in accordance with the present invention. The conveyor module 100 accepts the sheet 25 from the output end of folder module 20 and feeds it in a path of travel to the input end of downstream module 18. The conveyor module 100 includes a frame 102 and other suitable structure (not shown) for supporting and mounting various components and parts in the conveyor module 100. The frame 102 includes first positioning hole 112, second positioning hole 114 and third positioning hole 116. The positioning holes 112, 114 and 116 correspond to the first, second and third pair of folding rollers 22, 24 and 26, respectively. Rotatively mounted to the frame 102 is a drive shaft 104. The drive shaft 104 extends transverse to the path of travel and is located adjacent to the input end of the downstream module 18. The positioning holes 112, 114 and 116 are arranged in a radial pattern about the drive shaft 104. Thus, the distance between the drive shaft 104 and each of the positioning holes 112, 114 and 116 is a known constant.

A carriage assembly 120 having a lower portion 121 and an upper portion 201 extends between the output end of the folder module 20 and the input end of the downstream module 18. The lower portion 121 and the upper portion 201 define a friction drive system for conveying the sheet 25 along the path of travel. The lower portion 121 includes a horizontal deck 122 and laterally opposed side walls 140 extending vertically from the deck 122 and parallel to the path of travel on either side of the sheet 25. Together, the deck 122 and side walls 140 form a generally U-shaped structure. A plurality of drive rollers 132 and **132*a* are disposed between the output end of the folder module 20 and the input end of the downstream module 18. Fixably mounted to the underside of deck 122 and extending vertically downward are drive roller brackets 130. The drive roller brackets 130 are substantially parallel to the path of travel. Drive roller shafts 136 are rotatively mounted to drive roller brackets 130 and are aligned transverse to the path of travel. Rotatively mounted to the drive roller shafts 136 are drive rollers 132. Drive roller 132*a* is fixably mounted to the drive shaft 104. It should be noted that the deck 122 contains suitable openings 124 to allow a portion of the drive roller 132 and 132*a* to extend above the deck 122 in the path of travel of sheet 25. An endless belt 138 engages the plurality of drive rollers 132 and 132*a*. It is important that the endless belt 138 be of a suitable material to provide adequate friction so that there is no slip between drive rollers 132 and 132*a* and the endless belt 138. Thus, as the drive shaft 104 rotates causing drive rollers 132*a* to rotate, the endless belt 138 will rotate in synchronous fashion with drive rollers 132*a* and thereby cause drive rollers 132** to also rotate.

Also fixably mounted to the deck 122 is an optical sensor 270 for detecting the presence of the sheet 25 by providing the microcontroller 60 with a "blocked" signal when the sheet 25 is present or an "unblocked" signal when the sheet 25 is not present. It is important that the sensor 270 is mounted flush with the deck 122 so as not to obstruct the sheet 25 as it progresses along the path of travel. When the sensor 270 signal changes from unblocked to blocked, then the microcontroller 60 recognizes that the leading edge of the sheet 25 has passed the sensor 270. On the other hand, when the sensor 270 signal changes from blocked to unblocked, then the microcontroller recognizes that the trailing edge of the sheet 25 has passed the sensor 270.

The lower portion 121 is pivotably mounted to the drive shaft 104 using sleeves 126. Sleeves 126 are primarily hollow cylinders each having an inner hole 128 so that the sleeves 126 slip over the drive shaft 104. The diameter of inner holes 128 is selected relative to the diameter of the drive shaft 104 so that the drive shaft 104 rotates inside the inner holes 128. The side walls 140 have mounting flanges 146 which are adapted to fixably mount the side walls 140 to the sleeves 126. Those skilled in the art will now recognize that the lower portion 121 pivots about the drive shaft 104 independent of the rotation of the drive shaft 104.

Figure 7A:
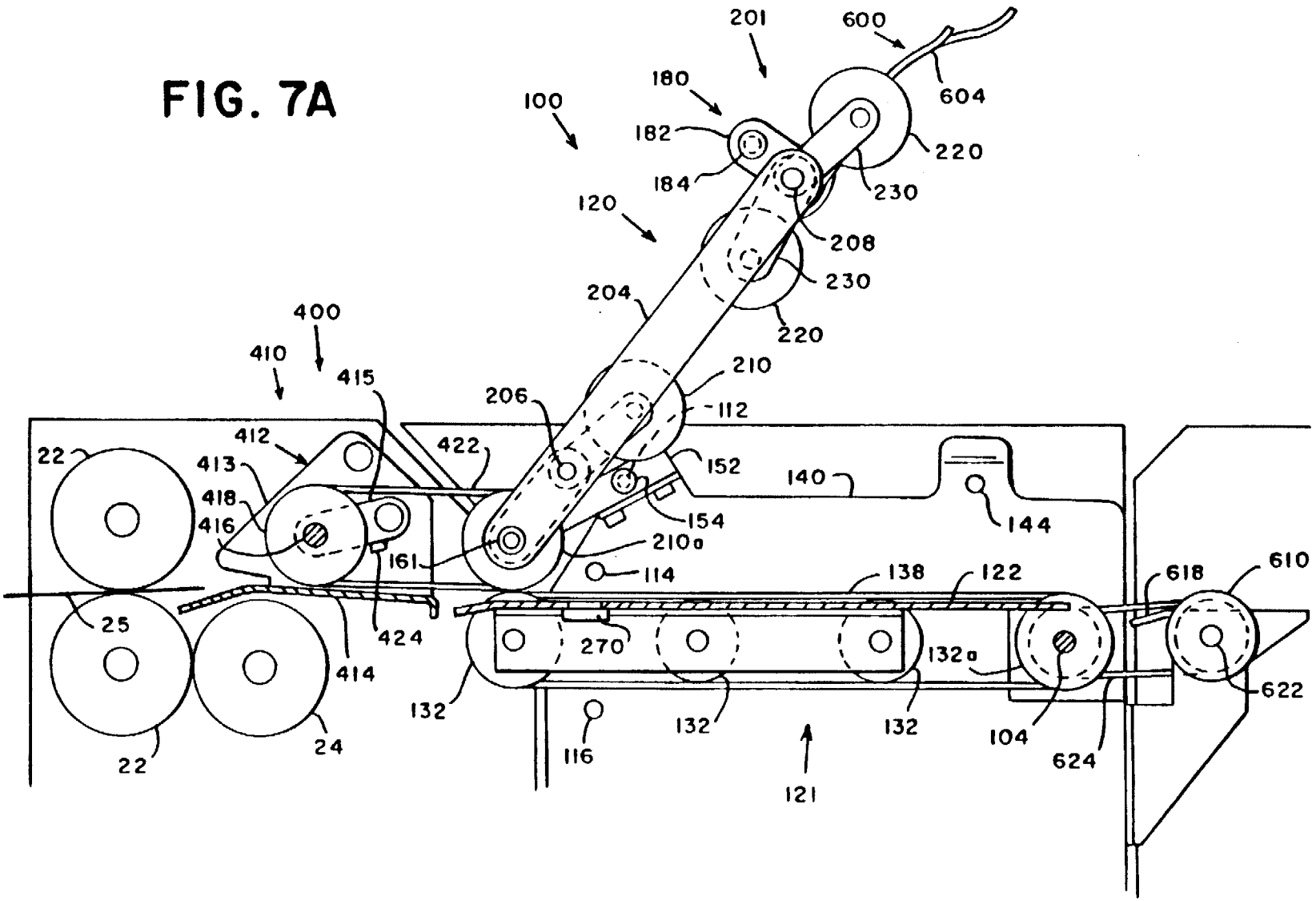
FIG. 7A is a front view of the conveyor module in position A having the upper portion of the carriage assembly in an open position in accordance with the present invention.
Figure 7B:
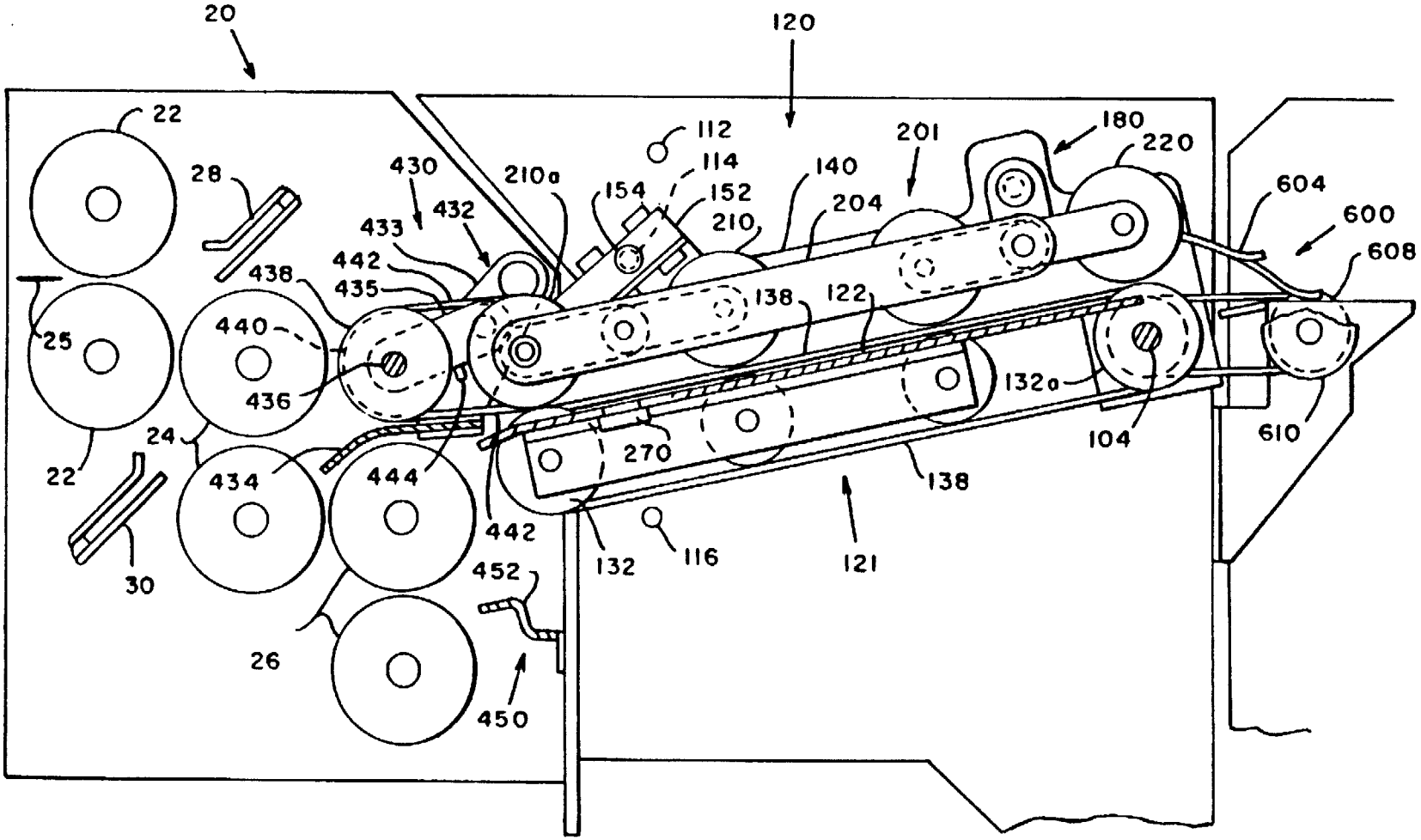
FIG. 7B is a front view of the conveyor module in position B having the upper portion of the carriage assembly in the closed position in accordance with the present invention.
Figure 7C:
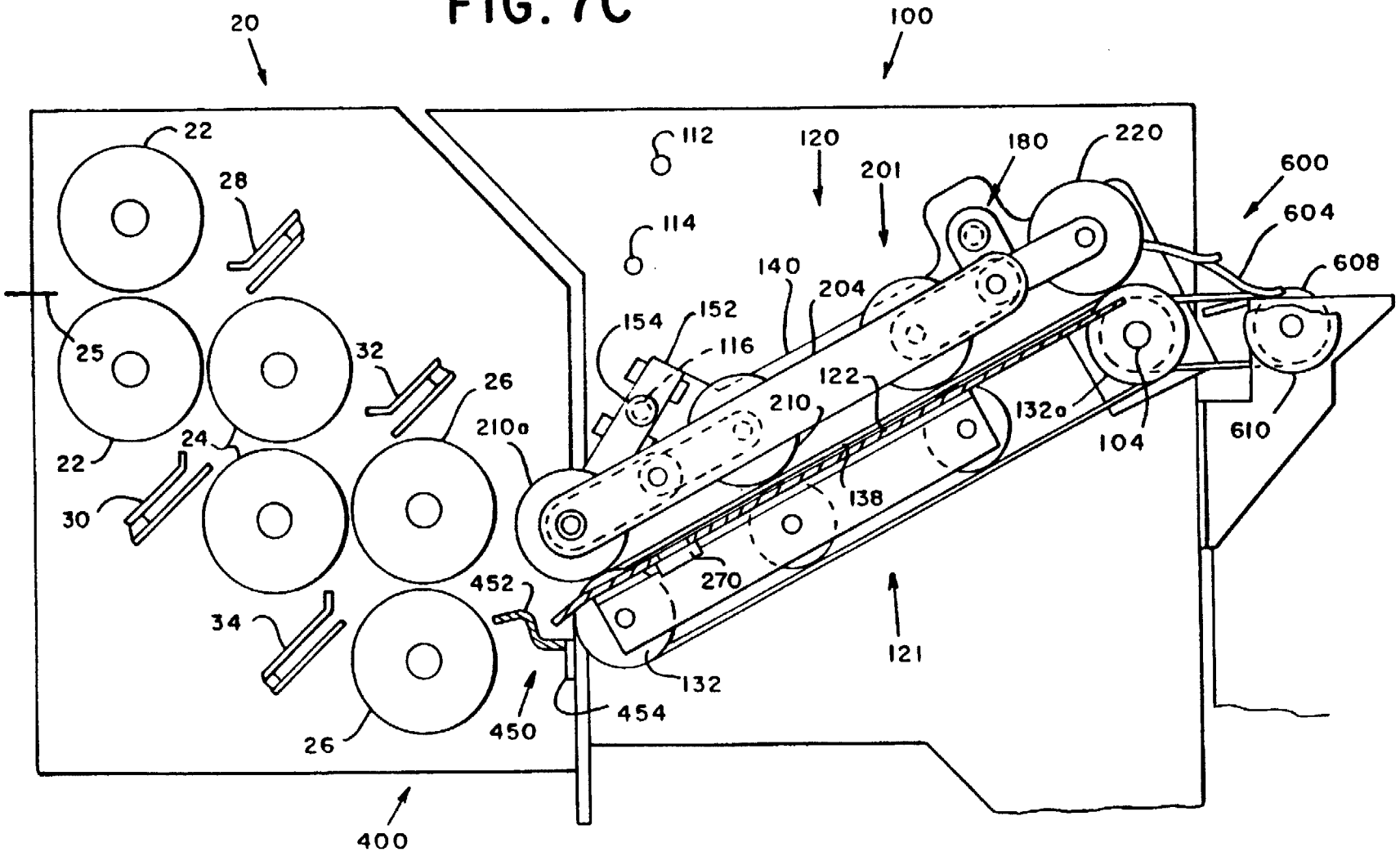
FIG. 7C is a front view of the conveyor module in position C having the upper portion of the carriage assembly in the closed position in accordance with the present invention.

A reposition latch assembly 150 is mounted to each of the side walls 140 for locking the carriage assembly 120 into one of three operative positions: position A as shown in FIGS. 3 and 7A, position B as shown in FIG. 7B and position C as shown in FIG. 7C. The following description is given only with respect to one of the side walls 140 since the other side is analogous. The reposition latch assembly 150 includes: a reposition latch bracket 152, a reposition latch pin 154, a reposition latch spring 156, E-clips 158 and arm 160. The bracket 152 includes a recess 162 and a through hole 164 while the pin 154 includes grooves 155. The pin 154 is inserted through the hole 164 and through the spring 156 while the E-clips 158 are attached to grooves 155. Thus, the E-clips 158 are on each side of hole 164 with the spring 156 captured between the recess 162 and one of the E-clips 158. This creates a spring bias on the pin 154. It should now be appreciated that the spring loaded pin 154 slides along hole 164 but cannot be removed from the bracket 152 due to the E-clips 158 on either side of the hole 164. The pin 154 is biased so as to insert into positioning holes 112, 114 and 116 to define the three operative positions A, B and C, respectively.

The upper portion 201 of carriage assembly 120 includes: elongate members 204, a first upper shaft 206 and a second upper shaft 208. One end of elongate members 204 is pivotally mounted to arms 160 at pivot point 161 by any suitable conventional means. The first upper shaft 206 is fixably mounted to extend between the elongate members 204. The second upper shaft 208 is located downstream from the first upper shaft 206 and is also fixably mounted to extend between the elongate members 204. Thus, members 204 and shafts 206 and 208 form a chassis or framework for mounting other components. Additionally, the second upper shaft 208 extends beyond the elongate members 204 and is fixably attached to jam access latch assembly 180.

The upper portion 201 also includes a plurality of idler rollers 210, **210*a* and 220. The idler rollers 210 and 210*a* are mounted to first upper shaft 206 while the idler rollers 220 are mounted to the second upper shaft 208. Each of the idler rollers 210, 210*a* and 220 are attached to their respective shafts 206 and 208 by a similar sub-assembly. The idler rollers 210, 210*a* and 220 are rotatively attached to one end of brackets 230 while the other end of brackets 230 is pivotably mounted to shafts 206 and 208, respectively. Torsion springs 232 are attached to brackets 230 and shafts 206 and 208**, respectively, by any suitable conventional means to provide a spring bias.

The jam access latch assembly 180 is mounted on both sides of the upper portion 201 for locking the upper portion 201 in a closed position where the upper portion 201 and the lower portion 121 are in working relationship. The following description is given only with respect to one side of the upper portion 201 since the other side is analogous. In the closed position, the idler rollers 210, 210*a* and 220 are disposed generally parallel to the drive rollers 132 and 132*a*. The jam access latch assembly 180 is very similar to the reposition latch assembly 150. The jam access latch assembly 180 includes: a bracket 182 with a through hole 190, a pin 184 with grooves 185, a spring 186 and E-clips 188. The pin 184 is inserted through the hole 190 and spring 186 while the E-clips 188 are attached to grooves 185. Thus, the E-clips 188 are on each side of hole 190 with the spring 186 captured between the bracket 182 and one of the E-clips 188. This creates a spring bias on the pin 184. It should now be appreciated that the spring loaded pin 184 slides along hole 190 but cannot be removed from the bracket 182 due to the E-clips 188 on either side of the hole 190. The pin 184 is biased so as to insert into a jam access latch hole 144 in the side walls 140 of lower portion 121 to maintain the upper portion 201 in the closed position. If the user pulls pins 184 inward, then the pins 184 will retract from the holes 190 and allow the upper portion 201 to pivot about pivot point 161 so that a jam can be cleared.

A drive assembly 300 provides input power for rotating the drive shaft 104. The drive assembly 300 includes: a conveyor pulley 302, a folder pulley 304, a tension pulley 306 and a notched drive belt 308. The conveyor pulley 302 is detachably mounted to the drive shaft 104 using a clutch/brake assembly 380. The folder pulley 304 is fixably mounted to a shaft 305 coming off of the third pair of folding rollers 26. The tension pulley 306 is rotatively mounted to an elongate bracket 310 which is pivotally mounted at one end to the frame 102 while the other end of the bracket 310 travels in a slot 316 in the frame 102. The bracket 310 includes a fastener 314 for locking the bracket 310 in place along the slot 316. Thus, the tension pulley 306 can be adjusted to insure that adequate tension is provided on the notched drive belt 308. Accordingly, as the third pair of folding rollers 26 rotates, the folder pulley 304 also rotates and provides the input drive necessary to cause the drive shaft 104 to rotate.

The clutch/brake assembly 380 selectively couples and uncouples the conveyor pulley 302 from the drive shaft 104 based on signals provided over bus 64 from the microcontroller 60. To couple and uncouple the conveyor pulley 302 from the drive shaft 104, the clutch/brake assembly 380 includes a conventional clutch (not shown). When the conveyor pulley 302 is operatively coupled to the drive shaft 104, then the drive shaft 104 is caused to rotate along with the conveyor pulley 302. On the other hand, when the conveyor pulley 302 is uncoupled from the drive shaft 104, then the drive shaft 104 does not rotate along with the conveyor pulley 302. To provide braking, the assembly 380 includes a brake arm 384 having a slot 385 and a brake pin 386 fixably mounted to the frame 102 and passing through the slot 385. The brake pin 386 interferes with and prevents rotation of the arm 384. When the conveyor pulley 302 is operatively coupled to the drive shaft 104, then the brake arm 384 does not rotate with the drive shaft 104. Thus, the brake arm 384 does not bear on the pin 386. On the other hand, when the conveyor pulley 302 is uncoupled from the drive shaft 104, then the brake arm 384 does rotate with the drive shaft 104 causing the arm 384 to bear on the pin 386. Thus, the arm 384 and pin 386 absorb the torque applied to the drive shaft 104 and cause the drive shaft 104 to stop rotating. The clutch/brake assembly 380 as described above is common or stock item typically available from a variety of mechanical component vendors.

Referring to FIG. 3, the carriage assembly 120 is shown in operative position A with the pins 154 in first repositioning holes 112. In this position, the buckle chute 28 is removed from the folder module 20. Additionally, the upper portion 201 of the carriage assembly 120 is shown in the closed position with the idler rollers 210, 210*a* and 220 biased toward the corresponding drive rollers 132 and 132*a*. Thus, the idler rollers 210, 210*a* and 220 are in working relationship with the endless belt 138. In position A, the carriage assembly 120 is positioned to accept a sheet 25 as it exits from the first pair of folding rollers 22. Thus, the sheet 25 bypasses all of the buckle chutes 28, 30, 32 and 34. This is referred to as "straight through" operation where the sheet 25 is not being folded.

Referring to FIG. 7B, the carriage assembly 120 is shown in operative position B with the pins 154 in second repositioning holes 114. In this position, the buckle chute 32 is removed from the folder module 20. Additionally, the upper portion 201 of the carriage assembly 120 is shown in the closed position with the idler rollers 210, 210*a* and 220 in working relationship with the endless belt 138. In position B, the carriage assembly 120 is shown ready to accept a sheet from the second pair of folding rollers 24. Thus, the sheet 25 may potentially encounter buckle chutes 28 and 30, but not buckle chute 32. However, either buckle chute 28 or buckle chute 30 may be replaced by a diverter (not shown) so that in this position the sheet 25 only encounters one buckle chute instead of two buckle chutes.

Referring to FIG. 7C, the carriage assembly 120 is shown in operative position C with the pins 154 in third repositioning holes 116. As in FIGS. 3 and 7B, the upper portion 201 is in the closed position with the idler rollers 210, 210*a* and 220 in working relationship with the endless belt 138. In position C, the conveyor module 100 is shown positioned to accept the sheet 25 from the third pair of folding rollers 26. In this position, the sheet 25 potentially encounters all buckle chutes 28, 30, 32 and 34. However, any number of the buckle chutes 28, 30, 32 and 34 may be replaced with a diverter (not shown) so that the sheet 25 encounters one, two, three or four buckle chutes depending upon the desired fold configuration.

Referring to FIG. 7A, the carriage assembly 120 is shown in operative position A with the pins 154 in first repositioning holes 112. However, in contrast to FIGS. 3, 7B and 7C, the upper portion 201 is shown in the open position with the idler rollers 210 and 220 spaced apart from the endless belt 138. In the open position, the user has access to the friction drive system for clearing a sheet 25 that has jammed. Although the open position of the upper portion 201 is only shown with respect to position A, it will be understood by those skilled in the art that the upper portion 201 can be in the closed or open position in each of the operative positions A, B and C.

Referring to FIGS. 3, 7B and 7C, it should now be appreciated that the distance between the first pair of folding rollers 22 and the carriage assembly 121 in position A is greater than the distance between the third pair of folding rollers 26 and the carriage assembly 121 in position C. Accordingly, the distance between the second pair of folding rollers 24 and the carriage assembly 121 in position B is greater than the distance between the third pair of folding rollers 26 and the carriage assembly 121 in position C but less than the distance between the first pair of folding rollers 22 and the carriage assembly 121 in position A. This arrangement is consistent with the variable and changing length of the sheet 25 as it passes through the folder module 20. The longest sheet 25 will be the one that has no folds and operates in position A in "straight through" mode. Conversely, the shortest sheet 25 is the one that passes through the most buckle chutes 28, 30, 32 and 34 and therefore has the most folds. This shortest sheet 25, will exit the third pair of folding rollers 26 when the carriage assembly 121 is in position C.

In most instances, the original length of the sheet 25 before entering the folder module 20 is sufficient to ensure that the sheet 25 will bridge the gap or distance between the folding rollers 22, 24 and 26 and the carriage assembly 120 in operative positions A, B and C, respectively. However, to accommodate those situations where the operator is using sheets 25 with a very small original length, a first guide assembly 400 is provided to bridge the distance between the folding rollers 22, 24 and 26 and the endless belt 138. The first guide assembly 400 exists in three different versions corresponding to the different operating positions of the carriage assembly 120. The first guide assembly version A 410 corresponds to position A of the carriage assembly 120. The first guide assembly version B 430 corresponds to position B of the carriage assembly 120. Similarly, the first guide assembly version C 450 corresponds to position C of the carriage assembly 120.

Referring to FIGS. 3, 4, 5 and 7A, the first guide assembly version A 410 is shown. Version A 410 includes a generally U-shaped bracket 412 having a guide portion 414 and side walls 413. The side walls 413 are detachably mounted to the folder module 20. The guide portion 414 is disposed in the path of travel so as to cover the second pair of folding rollers 24 and guide the sheet 25 from the first pair of folding rollers 22 to the endless belt 138. Arms 415 are pivotally mounted at one end to the side walls 413. Fixably mounted to the other end of the arms 415 is a shaft 416. Rotatively mounted to the shaft 416 are drive rollers 418 having grooves 420. O-rings 422 extend between the drive rollers 418 and the idler rollers 210*a* fitting inside of grooves 420 and 212*a*, respectively. Thus, it is now understood that the drive rollers 418 receive their input from the idler rollers 210*a*. Additionally, the side walls 413 have stops 424 which are located so as to prevent excessive downward rotation of the arms 415. In this way, the O-rings 422 are prevented from contacting the guide portion 414 of the bracket 412. However, the arms 415 are free to rotate away from the guide portion 414 to accommodate different thicknesses of sheet 25. Thus, version A compensates for different thicknesses of sheets 25 that are fed from the first pair of folding rollers 22, and also, prevents excessive wear of the O-rings 422 due to contact with the guide portion 414.

Referring to FIG. 7B, the first guide assembly version B 430 is shown. The first guide assembly version B 430 is used when the carriage assembly 120 is in position B. Generally, version B 430 is analogous to version A 410. However, the exact shapes and configurations of version B 430 will change slightly due to the different distance between the second pair of folding rollers 22 and the endless belt 138 when the carriage assembly 120 is in position B. Version B 430 includes a generally U-shaped bracket 432 having a guide portion 434 and side walls 433. The side walls 433 are detachably mounted to the folder module 20. The guide portion 434 is disposed in the path of travel so as to cover the third pair of folding rollers 26 and guide the sheet 25 from the second pair of folding rollers 24 to the endless belt 138. Arms 435 are pivotally mounted at one end to the side walls 433. Fixably mounted to the other end of the arms 435 is a shaft 426. Rotatively mounted to the shaft 436 are drive rollers 438 having grooves 440. O-rings 442 extend between the drive rollers 438 and the idler rollers 210*a* fitting inside of grooves 440 and 212*a*, respectively. Thus, it is now understood that the drive rollers 438 receive their input from the idler rollers 210*a*. Additionally, the side walls 433 have stops 444 which are located so as to prevent excessive downward rotation of the arms 435. In this way, the O-rings 442 are prevented from contacting the guide portion 434 of the bracket 432. However, the arms 435 are free to rotate away from the guide portion 434 to accommodate different thicknesses of sheet 25. Thus, version B compensates for different thicknesses of sheets 25 that are fed from the second pair of folding rollers 24, and also, prevents excessive wear of the O-rings 442 due to contact with the guide portion 434.

Referring to FIG. 3, 4, 5 and 7C, the first guide assembly version C 450 is used when the carriage assembly 120 is in position C. In this position, the distance between the third pair of folding rollers 26 and the endless belt 138 is sufficiently small such that the active driven arrangements in version A 410 and version B 430 are unnecessary. Therefore, version C only requires a guide 452. The guide 452 is mounted on a bracket 454 that is fixably mounted to the folder module 20. Since first guide assembly version C does not cause any clearance problems with other components in either the folder module 20 or the conveyor module 100, it is permanently installed. In other words, version C is always present whether it is being used or not.

In similar fashion to the first guide assemblies 410, 430 and 450, a second guide assembly 600 is provided to assist the interface between the carriage assembly 120 and the input end of the downstream module 18. The second guide assembly 600 includes: a sleeve 602, a deflector 604, a first input roller 606 having groove 607, a second input roller 608 having groove 609, drive rollers 610, a first bracket 614, a second bracket 616, a shaft 622 and an O-ring 624. The second bracket 616 having a guide portion 618 and suitable openings 620. The first bracket 614 is fixably mounted to the frame 102 while the second bracket 616 is fixably mounted to the first bracket 614. The shaft 622 is rotatively mounted to the second bracket 616 and the drive rollers 610 are fixably mounted to each end of the shaft 622. The second input roller 608 is also fixably mounted to the shaft 622 between the drive rollers 610 and fitting inside the guide opening 620. The first input roller 606 is fixably mounted to the drive shaft 104. The O-ring 624 extends between the first input roller 606 and the second input roller 608 fitting inside of grooves 607 and 609, respectively. Thus, rotation of drive shaft 104 also causes rotation of shaft 622. The sleeve 602 has an axial through hole (not shown) and positioning holes 632. The second upper shaft 208 passes through the axial hole in the sleeve 602. Thus, the sleeve 602 is free to rotate about the shaft 208. The deflector 604 is fixably mounted to the sleeve 602 by thumb screws 634 which pass through the sleeve 602 to the shaft 208. Thus, the thumb screws 634 also lock the deflector 604 and sleeve 602 in place on the shaft 208. Accordingly, the thumb screws 634 are used to adjustably position the deflector 604 and sleeve 602 radially about the shaft 208.

Those skilled in the art will now recognize that the folder module 20 supplies all the input necessary to drive the conveyor module 100, including: carriage assembly 120, first guide assembly version A 410, first guide assembly version B 430 and second guide assembly 600. The drive assembly 300 borrows power from the folder rollers drive system (not shown) and delivers it to the drive shaft 104 which in turn supplies the input necessary for the friction drive system of the carriage assembly 120. The first guide assembly version A 410 and first guide assembly version B 430 are driven off of idler rollers 210*a* while the second guide assembly 600 is driven off of input roller 606 which is also mounted to drive shaft 104.

Referring to FIGS. 3, 7B and 7C, the user must first determine how the sheets 25 are to be processed before the folder module 20 and the conveyor module 100 can be set up. The desired fold configuration of the sheet 25, determines the number of buckle chutes 28, 30, 32 and 34 as well as the number of folding rollers 22, 24 and 26 that are needed. Therefore, the user first sets up the folder module 20 by installing and/or removing buckle chutes 28, 30, 32 and 34 as necessary to achieve the desired fold configuration. Thus, the user now knows which pair of folding rollers 22, 24 and 26 the sheet 25 will exit from. Next, the user will reposition the carriage assembly 120 to accept the sheet 25 as it exits the folder module 20. This is achieved by pulling inward toward the center line CL of the sheet 25 on reposition latch pins 154. Pulling on the pins 154 causes them to retract from the corresponding positioning holes 112, 114 and 116. With the pins 154 in the retracted position, the carriage assembly 120 is now free to pivot about drive shaft 104. Thus, the carriage assembly 120 can now be moved into position A, B or C depending on where the sheet 25 will exit the folder module 20. Once the carriage assembly 120 is rotated to the desired position, the user releases the latch pins 154 and the springs 156 force the pins 154 into the corresponding positioning holes 112, 114 or 116 and locking the carriage assembly 120 in place. If the carriage assembly 120 is in position A, then the first guide assembly version A is installed. If the carriage assembly 120 is in position B, then the first guide assembly version B is installed. If the carriage assembly 120 is in position C, then no further action is required by the user since first guide assembly version C is permanently installed. Next, the user will adjust the second guide assembly 600 that is adjacent the input end of the downstream module 18. Depending upon whether the carriage assembly 120 is in position A, B, or C, the deflector 604 may need to assume a different radial position along shaft 208. Therefore, the user may loosen the thumb screws 634 and rotate the deflector 604 and sleeve 602 about the shaft 208 until the desired position is reached. Tightening the thumb screws 634 locks the deflector 604 and sleeve 602 in the desired position. The folder module 20 and the conveyor module 100 are now ready to process sheets 25.

The following description is provided to detail how the sheet 25 flows through the folder module 20 and the conveyor module 100. The description is provided with respect to the carriage assembly 120 being in position A. However, this description is directly analogous to the carriage assembly 120 being in position B or C. The sheet 25 enters the input end of folder module 20 and exits the first pair of folding rollers 22. With the first buckle chute 28 removed and the first guide assembly version A 410 installed, the sheet 25 bypasses the second pair of folding rollers 24 and the third pair of folding rollers 26. From this it follows that the sheet 25 will also not encounter the second buckle chute 30, third buckle chute 32 and fourth buckle chute 34. The leading edge of sheet 25 contacts guide 414 and is directed away from the second pair of folding rollers 24. As the first pair of folding rollers 22 continues to the sheet 25, the O-ring 422 comes in contact with the sheet 25 and continues to feed it along the guide 414. Thus, the leading edge of the sheet 25 is fed into the nip between endless belt 138 and the first idler roller 210*a*. The idler rollers 210, 210*a* and 220 provide the normal force to press the sheet 25 against the endless belt 138. The endless belt 138 thus conveys the sheet 25 along the entire length of the carriage assembly 120. As the sheet 25 is fed from endless belt 138, the second guide assembly 600 ensures that the sheet 25 is properly fed into the input end of the downstream module 18. The deflector 604 directs the leading edge of the sheet 25 into contact with the O-ring 624. Next, the O-ring 624 feeds the sheet 25 from the conveyor module 100 and into the downstream module 18. Thus, the sheet 25 has been fully processed by the folder module 20 and the conveyor module 100.

In the event that the sheet 25 is not handled properly, and a jam occurs in the conveyor module 100, the jam access latch assembly 180 provides access to the conveyor module 100 so that the user may clear the sheet 25 from the conveyor module 100. This is achieved by pulling inward toward the centerline CL of the sheet 25 on the pins 184 which retract the pins 184 from the holes 144 in the side walls 140. The upper portion 201 is now free to pivot about the holes 190. Thus, the upper portion 201 is rotated into an open position where the idler rollers 210 and 220 are now spaced apart from the endless belt 138. In this open position, the user can retrieve the jammed sheet 25. It should now be appreciated by those skilled in the art that the jam access as described above is available regardless of whether the carriage assembly is in position A, B, or C. It is important to note that the upper portion 201 pivots about pivot point 161 which is in axial alignment with idler rollers 210*a* so as not to disturb the first guide assembly version A 410 in operative position A or, in the alternative, the first guide assembly version B 430 in operative position B. Thus, to clear a jam no disassembly of version A 410 or version B 430 is necessary. Additionally, the sub-assembly that mounts the idler rollers 210, 210*a* and 220 to their respective shafts 206 and 208 includes a stop (not shown) for limiting the rotation of the bracket 230 when the idler rollers 210, 210*a* and 220 lose contact with the endless belt 138.

Referring to FIGS. 2 and 3, in operation, sheets 25 are feed through the inserter 10 in the path of travel from the upstream modules 16 through the folder module 20 and conveyor module 100, as described above, and then along through the downstream modules 18. To regulate throughput and reliability of the inserter 10 the microcontroller 60 monitors and manages the flow of sheets 25 in the path of travel. To provide control over the sheet 25, it is important that at least one of the upstream modules 16 have means 17 for suspending feeding of the sheet 25 so that advancement of the sheet 25 in the path of travel is stopped. This capability is well known in the art and can exist in many different types of modules. For example, an accumulator module has the capability to stop the advancement of the sheet 25 in the path of travel so that additional or other sheets 25 can be amassed one on top of the other. Then the accumulated bundle of sheets 25 is released or once again advanced in the path of travel so that once again feeding of the sheet 25 in the path of travel continues. Thus, the suspending means 17 allows the upstream module 16 to selectively feed or advance the sheet in the path of travel. A more detailed explanation of one type of suspending means 17 is provided in U.S. Pat. No. 5,180,157, issued on Jan. 19, 1993 and assigned to the assignee of the present invention which is now specifically incorporated by reference.

In the preferred embodiment, the upstream module 16 with the suspending means 17 in bus 64 communication with the microcontroller 60 is adjacent to the folder module 20. This allows for greater reliability in operating the folder module 20 as the microcontroller 60 manages the flow of the sheet 25. Once the adjacent upstream module 16 releases or continues to feed the sheet 25 to the folder module 20, the microcontroller 60 causes the adjacent upstream module 16 to suspend feeding the subsequent sheet 25 until the conveyor module sensor 270 detects the trailing edge of the sheet 25 after it has successfully negotiated the folder module 20. When the sensor 270 detects the trailing edge of the sheet 25, the microcontroller 60 causes the adjacent upstream module 16 to release or continue feeding the subsequent sheet 25. By properly positioning the sensor 270 along the deck 122, the spacing between successive sheets 25 can be set to a desired dimension. Thus, proper spacing between the sheets 25 after the folder module 20 is maintained.

To detect jams in the folder module 20, the microcontroller 60 commences a count of a fold time interval $t_{fold}$ when the adjacent upstream module 16 feeds the sheet 25 in the path of travel to the folder module 20. Depending on the length of the sheet 25, the desired fold configuration and the speed at which the sheet 25 is feed through the inserter 10, the time necessary for the sheet 25 to successfully negotiate the folder module 20 and pass sensor 270 is known. The necessary time plus a small additional amount of time as a safety factor is defined as $t_{threshold}$ which is stored in memory in the microcontroller 60. Therefore, by comparing $t_{fold}$ with $t_{threshold}$ the microcontroller 60 can be determined whether or not a jam has occurred in the folder module 20. It is important that the safety factor is incorporated into $t_{threshold}$ so that false indications of a jam do not occur. If $t_{fold}$ is less than $t_{threshold}$ then the inserter 10 continues to operate and the count of the fold time interval $t_{fold}$ also continues. The microcontroller 60 continues to compare $t_{fold}$ with $t_{threshold}$ until either the sensor 270 detects the trailing edge of the sheet 25 or $t_{fold}$ becomes greater than or equal to $t_{threshold}$. Once the sensor 270 detects the trailing edge of the sheet 25, then the microcontroller resets the count of the fold time interval $t_{fold}$ to zero and causes the adjacent upstream module 16 to feed the subsequent sheet 25 into the folder module 20. On the other hand, if $t_{fold}$ is greater than or equal to $t_{threshold}$, then too much time has elapsed since the adjacent upstream module 16 released the sheet 25 and most likely a jam has occurred in the folder module 20. In this case, the microcontroller 60 causes the conveyor module 100 to terminate or stop rotating the drive rollers **132*a* and 132 by signaling the clutch-brake assembly 380 to uncouple the drive shaft 104 from the conveyor pulley 302 and does not cause the adjacent upstream module 16 to feed the subsequent sheet 25. Thus, a pile-up of sheets 25 in the folder module 20** is prevented and the severity of the jam is reduced because less sheets have been damaged and less operator intervention is required.

In addition to preventing pile-ups in the folder module 20, the present invention also contemplates preventing pile-ups downstream from the folder module 20. To achieve this, at least one of the downstream modules 18 must have means 19 for detecting a jam. This capability is well known in the art and can exist in many different types of modules. Typically, this involves the use of an optical sensor disposed along the path of travel can detect the presence of the sheet 25. For example, if the sensor remains blocked or in a state indicating that the sheet 25 is present for greater than a specified period of time, then most likely a jam has occurred. Another example is analogous the description provide above where the sheet 25 is released from a first position and does not reach a second position within a specified time. Thus, it can be determined that the sheet 25 has jammed somewhere between the first position and the second position.

In the preferred embodiment, the downstream module 18 with the jam detecting means 19 in bus 64 communication with the microcontroller 60 is adjacent to the conveyor module 100. This allows for greater reliability in operating the overall inserter 10 as the microcontroller 60 manages the flow of the sheet 25. So long as the adjacent downstream module 18 does not detect a jam, the inserter 10 continues to operate. However, once the jam detecting means 19 detects a jam, the microcontroller 60 causes the conveyor module 100 to terminate or stop rotating the drive rollers **132*a* and 132 by signaling the clutch-brake assembly 380 to uncouple the drive shaft 104 from the conveyor pulley 302. Therefore, if there is a sheet 25 present in the conveyor module 100 it is not feed into the downstream module 18. Thus, a pile-up of sheets 25 in the adjacent downstream module 18 is prevented and the severity of the jam is reduced because less sheets 25** have been damaged and less operator intervention is required.

Many features of the preferred embodiment represent design choices selected to best exploit the inventive concept for as implemented in an inserter at the folder module output end. However, the present invention may have application to solve similar related problems. Moreover, additional advantages and modifications will readily occur to those skilled in the art. Therefore, the invention in its broader aspects is not limited to the specific details of the preferred embodiment. Accordingly, various modifications may be made without departing from the spirit of the general inventive concept as defined by the appended claims and their equivalents.

What is claimed is:

1. An inserter comprising:

a frame;

means for feeding a sheet having a trailing edge in a path of travel;

a first module including means for suspending feeding of said sheet;

a folder module located downstream from said first module, said folder module including a plurality of pairs of folding rollers;

a second module located downstream from said folder module, said second module including means for detecting a jam;

a conveyor module located downstream from said folder module and upstream from said second module, said conveyor module including means for conveying said sheet and means for sensing the presence of said sheet, said conveying means including a carriage having an input end adjacent to said folder module and an output end said carriage including a lower portion pivotably mounted to said frame at said carriage output end so that said carriage input end is pivotable to a plurality of positions adjacent to corresponding pairs of said plurality of pairs of folding rollers, said carriage further including an upper portion; and said lower portion including: a deck, a plurality of drive rollers rotatively mounted to said lower portion so that a portion of said drive rollers extends above said deck, and an endless belt engaging said plurality of drive rollers; and said upper portion including: a chassis pivotably mounted to said lower portion so that said chassis is rotatable between a closed position and an open position, a plurality of idler rollers rotatively mounted to said chassis so that in said closed position said idler rollers are in working relationship with said endless belt, and said conveyor means further including drive means for rotating said drive rollers;

microcontroller means in operative communication with said first module, said folder module, said conveyor module sensing means, said conveyor module conveying means and said second module detecting means, said microcontroller means for:

(a) signaling said conveyor module conveying means to stop conveying said sheet when said second module detecting means detects said jam; and (b) signaling said first module suspending means to continue feeding said sheet in said path of travel when said conveyor module sensing means senses said trailing edge of said sheet.

2. The inserter of claim 1, wherein said conveyor means further includes clutch-brake means for selectively disengaging said drive rollers from said drive means and preventing further rotation of said drive rollers after said drive rollers are disengaged from said drive means.

3. The inserter of claim 2, wherein said microcontroller signals said conveyor module conveying means to stop conveying said sheet when said second module detecting means detects said jam by signaling said clutch-brake means to disengage said drive rollers from said drive means and prevent further rotation of said drive rollers.

4. An inserter comprising:

a frame;

means for feeding a sheet having a trailing edge in a path of travel;

a first module including means for suspending feeding of said sheet;

a folder module located downstream from said first module, said folder module including a plurality of pairs of folding rollers;

a second module located downstream from said folder module, said second module including means for detecting a jam;

a conveyor module located downstream from said folder module and upstream from said second module, said conveyor module including means for conveying said sheet and means for sensing the presence of said sheet, said conveying means including a carriage having an input end adjacent to said folder module and an output end, said carriage including a lower portion pivotably mounted to said frame at said carriage output end so that said carriage input end is pivotable to a plurality of positions adjacent to corresponding pairs of said plurality of pairs of folding rollers;

microcontroller means in operative communication with said first module, said folder module, said conveyer module sensing means, said conveyer module conveying means and said second module detecting means, said microcontroller means for:

(a) signaling said conveyer module conveying means to stop conveying said sheet when said second module detecting means detects said jam;

(b) signaling said first module suspending means to continue feeding said sheet in said path of travel when said conveyer module sensing means senses said trailing edge of said sheet;

(c) commencing a count of a fold time interval when said first module suspending means continues to feed said sheet in said path of travel;

(d) determining if said fold time interval count is less than a threshold time interval; and (e) signaling said conveyer module to terminate operation if said fold time interval count is not less than said threshold time interval.

5. The inserter of claim 4, wherein said conveyer module further includes clutch-brake means for selectively disengaging said drive rollers from said drive means and preventing further rotation of said drive rollers after said drive rollers are disengaged from said drive means; and said microcontroller signals said conveyer module conveying means to stop conveying said sheet when said second module detecting means detects said jam by signaling said clutch-brake means to disengage said drive rollers from said drive means and prevent further rotation of said drive rollers.

6. An inserter comprising:

a frame having a plurality of positioning holes; means for feeding a sheet having a leading edge and a trailing edge in a path of travel;

a first module including means for suspending feeding of said sheet;

a folder module located downstream from said first module, said folder module including a plurality of pairs of folding rollers and a plurality of buckle chutes, said pairs of folding rollers offset both laterally and vertically from one another, said plurality of positioning holes in operative alignment with said plurality of pairs of folding rollers, respectively;

a second module located downstream from said folder module, said second module including means for detecting a jam;

a conveyor module located downstream from and adjacent to said folder module and upstream from said second module, said conveyor module having an input end and an output end, said conveyor module including:

a carriage extending between said conveyor module input end and said conveyor module output end, said carriage including a lower portion, an upper portion and means for sensing the presence of said sheet, said lower portion pivotably mounted to said frame so that said conveyor module input end is pivotable to a plurality of positions adjacent to corresponding pairs of said plurality of pairs of folding rollers, said lower portion including:

an elongate deck, a plurality of drive rollers rotatively mounted to said lower portion so that a portion of said drive rollers extends above said deck, an endless belt engaging said plurality of drive rollers, and first latch means for detachably mounting to said positioning holes and locking said carriage adjacent a selected one of said plurality of pairs of folding rollers, and said upper portion including:

a chassis pivotably mounted to said lower portion, a plurality of idler rollers including a first idler roller adjacent said folder module, said plurality of idler rollers rotatively mounted to said chassis so that in a closed position said idler rollers are in working relationship with said endless belt and in an open position some of said idler rollers are spaced apart from said endless belt, said chassis pivoting about a point in axial alignment with said first idler roller, means for biasing said idler rollers in said closed position toward said opposing drive rollers to press said sheet against said endless belt, and second latch means for detachably mounting to said lower portion and locking said upper portion in said closed position;

drive means for rotating said drive rollers, clutch-brake means for selectively disengaging said drive rollers from said drive means and preventing further rotation of said drive rollers after said drive rollers are disengaged from said drive means;

a first guide assembly including a guide detachably mounted to said frame and positioned adjacent said selected one of said plurality of folding rollers to guide said sheet away from said folder module and first guide drive means for feeding said sheet to said endless belt, said endless belt feeding said sheet in said path of travel toward said second module; and microcontroller means in operative communication with said first module, said folder module, said conveyor module sensing means, said conveyor module drive means and said second module detecting means, said microcontroller means for:

(a) signaling said conveyor module clutch-brake means to disengage said drive rollers from said conveyor module drive means and prevent further rotation of said drive rollers when said second module detecting means detects said jam; and (b) signaling said first module suspending means to continue feeding said sheet in said path of travel when said conveyor module sensing means senses said trailing edge of said sheet.

7. The inserter of claim 6, wherein said microcontroller means further for:

(c) commencing a count of a fold time interval when said first module suspending means continues to feed said sheet in said path of travel;

(d) determining if said fold time interval count is less than a threshold time interval; and (e) signaling said conveyor module clutch-brake means to disengage said drive rollers from said conveyor module drive means and prevent further rotation of said drive rollers if said fold time interval count is not less than said threshold time interval.

* * * * *